US005518191A

United States Patent [19]

Bartsch et al.

[11] Patent Number: 5,518,191

[45] Date of Patent: May 21, 1996

[54] AGITATOR MILL

[75] Inventors: Robert Bartsch, Schworstadt; Hans Brogli, Zeiningen, both of Germany

[73] Assignee: Fryma-Maschinen AG, Theodorshofweg, Switzerland

[21] Appl. No.: 297,306

[22] Filed: Aug. 26, 1994

[30] Foreign Application Priority Data

Aug. 31, 1993 [DE] Germany ..... 43 29 339.5

[51] Int. Cl.[6] ..... B02C 17/00; B02C 17/18

[52] U.S. Cl. ..... 241/46.11; 241/171; 241/179

[58] Field of Search ..... 241/172, 179, 241/180, 46.11, 171

[56] References Cited

U.S. PATENT DOCUMENTS

| | | | |
|---|---|---|---|
| 3,814,334 | 6/1974 | Funk | 241/70 |
| 3,924,814 | 12/1975 | Fahlstrom et al. | 241/80 |
| 4,067,505 | 1/1978 | Pujol | 241/171 |
| 4,629,133 | 12/1986 | Buhler | 241/46.11 |
| 4,709,863 | 12/1987 | Szkaradek et al. | 241/69 |
| 5,193,754 | 3/1993 | Pujol | 241/65 |
| 5,333,804 | 8/1994 | Liebert | 241/69 |

FOREIGN PATENT DOCUMENTS

| | | |
|---|---|---|
| 45700 | 11/1966 | Germany . |
| 90 04 117.8 | 9/1991 | Germany . |
| 40 10 926.7 | 10/1991 | Germany . |

*Primary Examiner*—John M. Husar
*Attorney, Agent, or Firm*—Learman & McCulloch

[57] ABSTRACT

The invention relates to an agitator mill which has both a static separating arrangement and a dynamic separating arrangement on the outlet side of the grinding chamber. These two separating arrangements complement one another in an ideal manner, since in the starting phase in particular the dynamic separating arrangement ensures a trouble-free start, whilst during operation the static separating arrangement enlarges the total effective opening in a desired manner and thus leads to a low pressure in the mill. Thus the agitator mill according to the invention is distinguished by a high level of reliability, low maintenance costs, low wear and universal applicability.

11 Claims, 4 Drawing Sheets

AGITATOR MILL

The invention relates to an agitator mill for wet crushing, comprising a) a grinding chamber to which fresh material for subsequent grinding is delivered on the inlet side and from the outlet side of which crushed material to be ground is extracted, b) and a static separating arrangement disposed on the outlet side of the grinding chamber and having at least one opening defined by elements which are not movable relative to one another, the width of the said opening being dimensioned so that the crushed material for grinding passes through but the auxiliary grinding elements are retained.

BACKGROUND OF THE INVENTION

Agitator mills of the aforementioned generic type are known for example from DE-GM 90 04 117.8 and DE-A 40 10 926.7.

The static separating arrangement is formed in this case by a screen, preferably a bar screen, which is disposed rotatably or stationary on the outlet side of the grinding chamber. A disadvantage with such constructions is that the screen can become clogged by auxiliary grinding elements or fragments thereof in the course or lengthy operation and moreover when the agitator mill is stopped the suspension of material to be ground (together with auxiliary grinding elements and fragments thereof) can be deposited and dry out on the screen, which in unfavourable cases closes off the openings of the static separating arrangement so that restarting of the agitator mill is precluded before an intensive cleaning or replacement of the screen. In the case of very narrow openings in the static separating arrangement, high pressure values and high flow speeds are also produced in operation, so that fragments of auxiliary grinding elements are pressed into the openings and the operation of the separating arrangement is substantially impaired.

So long as the static separating arrangement is arranged rotatably in the aforementioned known constructions, a sealing gap which is advantageously adjustable in size (cf. for instance FIG. 1 of DE-A 40 10 926.7) is situated between this rotating separating arrangement and the adjacent stationary housing. The width of such a sealing gap is set so narrow that neither auxiliary grinding elements nor material for grinding can pass through.

A dispersing device is also known from DD-A 45 700 in which a conically shaped annular screen, which tapers downwards as far as the suction region of an agitator disc mounted on the agitator shaft, is connected to the agitator shaft. In this case a free annular gap which is two to three times as wide as the diameter of the largest grinding element is provided between the lower end of the screen and the agitator shaft. In operation not only can the suspension flowing back stream through this annular gap but in view of the width of the annular chamber grinding elements, which come into the region of the annular chamber during starting or stopping of the dispersing device, can also pass through the annular gap.

The object of the invention is to construct an agitator mill of the aforementioned generic type in such a way that on the one hand a reliable and trouble-free separation of auxiliary grinding elements and fragments thereof out of the suspension of material to be ground takes place and on the other hand maintenance work, particularly on the static separating arrangement, is greatly reduced.

SUMMARY OF THE INVENTION

This object is achieved according to the invention in that on the outlet side of the grinding chamber a dynamic separating arrangement is also provided which has at least one opening defined by elements which are movable relative to one another, the width of this opening being dimensioned so that the crushed material to be ground passes through but the auxiliary grinding elements are retained.

Thus the combination of a static and a dynamic separating arrangement is characteristic of the agitator mill according to the invention. As the extensive tests on which the invention is based showed, by such a combination a reliable and almost maintenance-free separation of suspension and auxiliary grinding elements can be achieved, since the static and the dynamic separating arrangements complement each other in an ideal manner in the different operating conditions.

Thus even in the event of drying out of the static separating arrangement the agitator mill can be restarted without a high pressure build-up within the mill due to the fact that in this case the dynamic separating arrangement operates freely and thus in the starting phase the suspension of material for grinding can flow through the dynamic separating arrangement. In this case the suspension dried onto the static separating arrangement is simultaneously detached automatically (i.e. without special maintenance measures) and thus the separating arrangement is washed free after a short time, so that an additional cleaning operation which would lead to an interruption of operation is unnecessary.

Since on the other hand in normal operation the free opening of the static separating arrangement is added to the free opening of the dynamic separating arrangement, and therefore the total opening of the static and dynamic separating arrangement is relatively large, the pressure build-up during operation of the agitator mill is small. In this way fragments of auxiliary grinding agents are largely prevented from being pressed into the static or dynamic separating arrangement. The combined separating arrangement also offers the possibility of working intrinsically viscous or highly thixotropic products without an increased pressure build-up, since the dynamic separating arrangement breaks up thixotropies or intrinsic viscosities by the resulting drop in shear.

THE DRAWINGS

Advantageous embodiments of the invention are the subject matter of the subordinate claims and are explained in connection with the description of several embodiments which are illustrated in the drawings, in which FIG. 1 shows a vertical section through a first embodiment of the agitator mill according to the invention, FIG. 2 shows a partial representation (on an enlarged scale) of the static and dynamic separating arrangement of the agitator mill according to FIG. 1, FIGS. 3 to 6 show variants of the arrangement according to FIG. 2.

DETAILED DESCRIPTION

Figure 1:
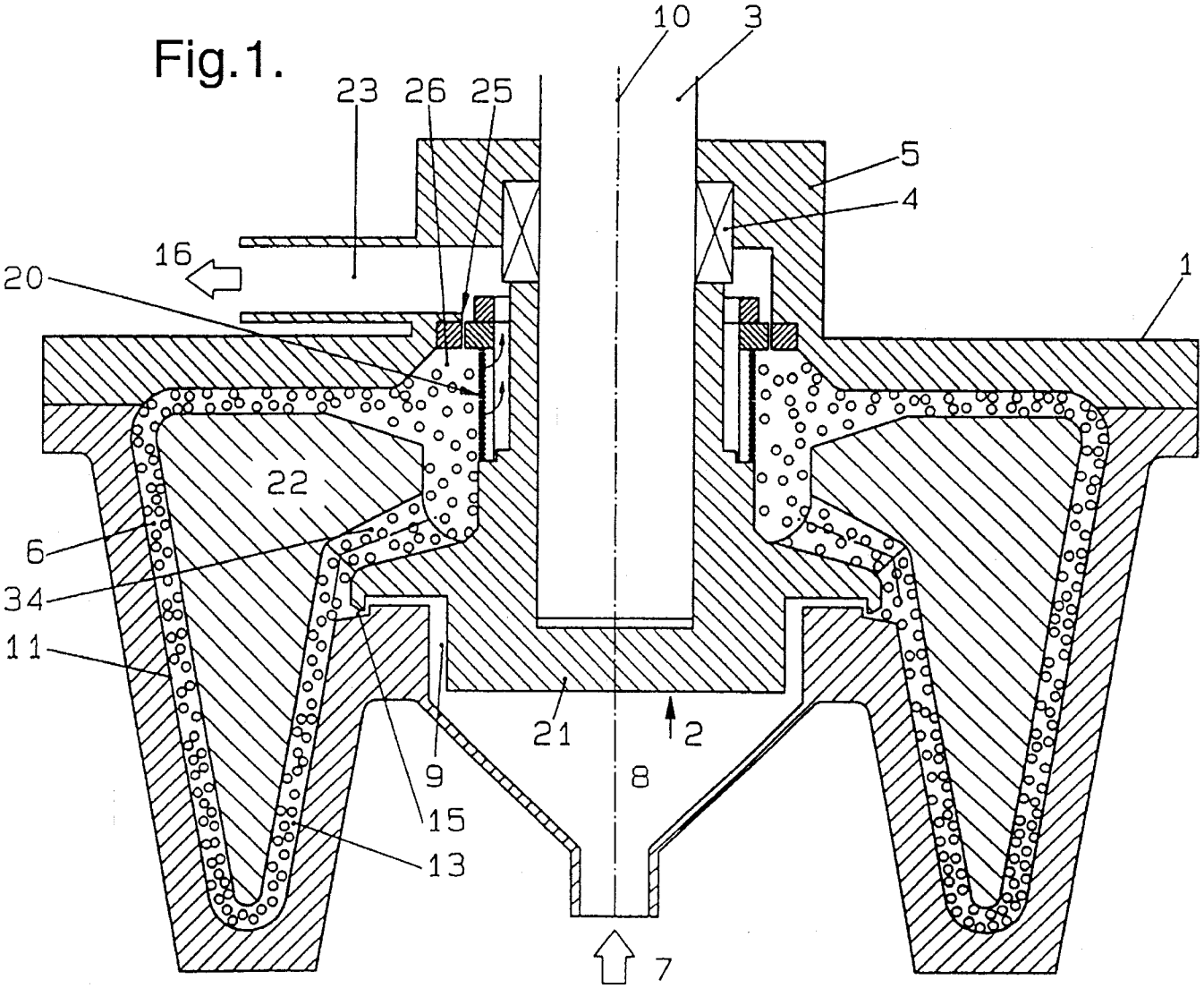

The agitator mill shown in FIG. 1 comprises a housing 1 and a rotor 2. The hub body 21 of the rotor 2 sits on a shaft 3 which is mounted by means of a bearing 4 in a bearing receptacle 5 of the housing 1 and is driven from above by a drive motor (which is not shown).

A rotor 22 which is firmly connected to the hub body 21 projects as a displacement body into a recess 13 in the housing 1. The peripheral wall 11 of this recess 13 together with the peripheral wall 14 of the rotor 22 defines a gap-shaped grinding chamber 6 adapted to hold auxiliary grinding elements (i.e., grinding media).

In its lower funnel-shaped region the housing 1 forms a feed chamber 8 for the material or product to be ground delivered in the direction of the arrow 7. The feed chamber is connected by an annular channel 9 and a material inlet 15 to the grinding chamber 6. On the outlet side of the grinding chamber 6 there is provided on the one hand a static separating arrangement formed by a bar screen 20 and on the other hand a dynamic separating arrangement constructed as a dynamic opening or friction gap 25. The details of these two separating arrangements are explained more precisely width the aid of FIG. 2.

After passing through the bar screen 20 or the friction gap 25 the crushed material to be ground (i.e., the ground or processed product) is drawn off by way of an outlet channel 23 (arrow 16). By contrast, the auxiliary grinding elements pass from the outlet side 26 of the grinding chamber by way of return channels 34 to the inlet side of the grinding chamber 6, i.e. to the region of the material inlet 15.

Figure 2:
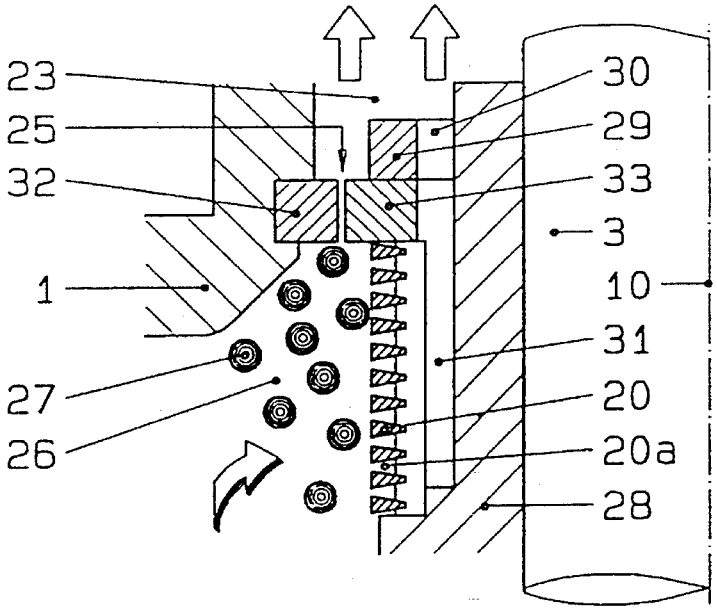

FIG. 2 shows the details of the static and dynamic separating arrangement of the agitator mill according to FIG. 1.

The static separating arrangement is formed by the bar screen 20 which is of cylindrical construction and disposed coaxially with respect to the axis 10 of the shaft 3. The bar screen 20 is produced from triangular profiled wire and has separating gaps 20*a*. These openings (separating gaps or static opening 20*a*) of the static separating arrangement (bar screen 20) which are defined by elements which are not movable relative to one another are dimensioned in width in such a way that the crushed material to be ground passes through but the auxiliary grinding elements 27 are retained.

In the embodiment illustrated in FIGS. 1 and 2 the bar screen 20 is gripped between two hub parts 28 and 29 which are firmly connected to the shaft 3. It therefore rotates with the shaft 3 and the rotor 22. Axial channels 30 through which the material to be ground passes out of the chamber 31 enclosed by the bar screen 20 to the outlet channel 23 are provided in the hub part 29.

The friction gap 25 forming the dynamic separating arrangement is defined by a ring 32, which is connected to the housing 1 and accordingly arranged stationary, and a ring 33, which is borne by the hub part 29 and accordingly rotating. The two rings 32, 33 are made from wear-resistant material. The width of the opening formed by the annular gap 25 is dimensioned so that the crushed material to be ground passes through, but on the other hand the auxiliary grinding elements 27 are retained.

The friction gap 25 connects the outlet side 26 of the grinding chamber 6 directly to the outlet channel 23.

The material to be ground crushed in the grinding chamber 6 flows from the outlet side 26 of the grinding chamber both through the bar screen 20 and also through the friction gap 25 into the outlet channel 23, whilst the auxiliary grinding elements 27 are retained. If after a lengthy shutdown of the agitator mill the two separating arrangements are obstructed by dried-on suspension of material to be ground, then during restarting of the mill the rotary movement of the ring 33 relative to the stationary ring 32 immediately clears the friction gap 25 so that the suspension of material for grinding can flow from the outlet side 26 to the outlet channel 23. In a short time the flow movement which is set up hereby on the outlet side 26 detaches the suspension of material to be ground which has dried onto the bar screen 20, so that the bar screen 20 is also washed free after a short time. Then during further operation both the static separating arrangement and also the dynamic separating arrangement contribute to the separation of the suspension of material to be ground from the auxiliary grinding elements, which in view of the relatively large total opening of the two separating arrangements leads to a low pressure build-up within the mill.

Figure 3:
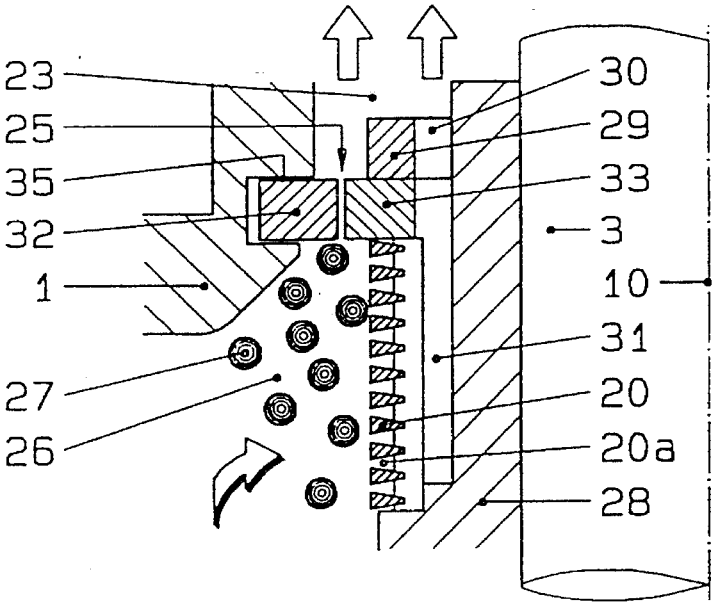

In the further embodiment illustrated in FIG. 3 the same reference numerals are used for the same elements. In this embodiment the ring 32 of the dynamic separating arrangement is mounted floating in a recess 35 of correspondingly large dimensions in the housing 1. In this way eccentric manufacturing tolerances can be compensated; which enables a very narrow friction gap 25 to be set.

Figure 4:
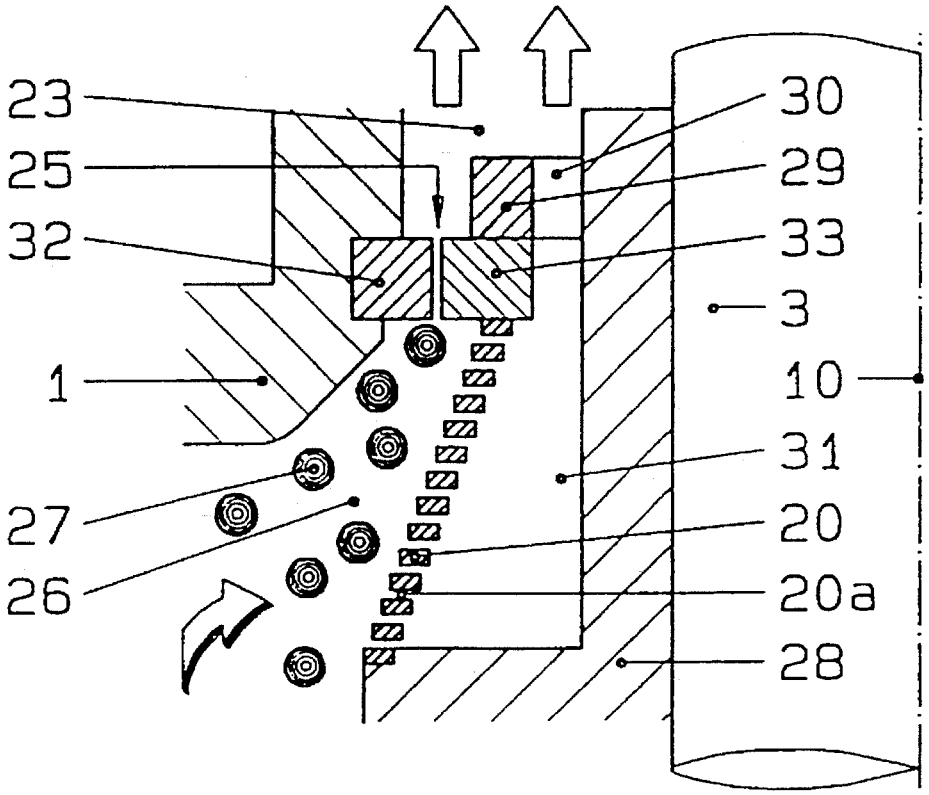

The embodiment according to FIG. 4 differs from the variant illustrated in FIG. 2 by the use of a conical bar screen 20.

Figure 5:
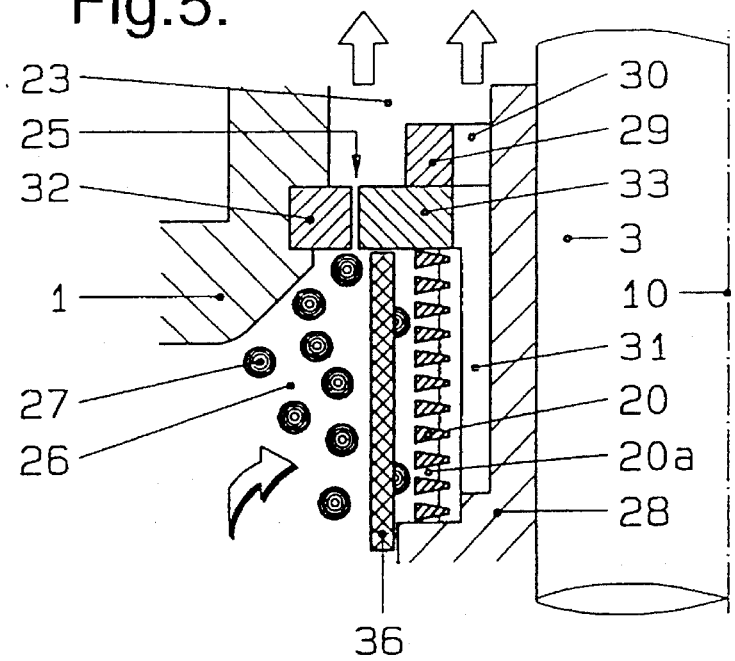

In the variant of the embodiment according to FIG. 2 which is illustrated in FIG. 5 centrifugal vanes 36, which ensure the turbulent motion of the suspension of material to be ground in the inlet region of the bar screen 20 and thus delay clogging of the bar screen 20, are disposed with radial spacing before the bar screen 20.

These centrifugal vanes 36 can be constructed helically and disposed so that entrained auxiliary grinding elements 27 can be carried away from the dynamic separating arrangement, i.e. from the friction gap 25. In this way it is possible in particular to reduce the wear on the rings 32 and 33 defining the friction gap.

Figure 6:
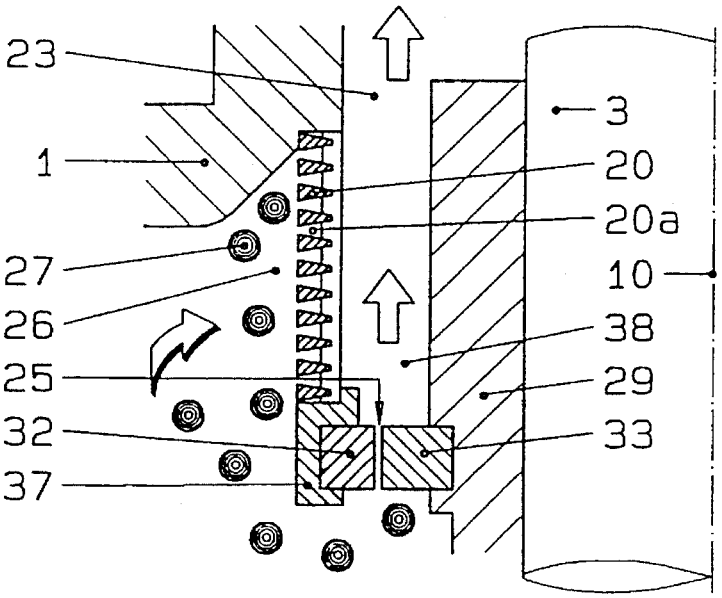

Whereas in the previously described embodiments the bar screen 20 is arranged rotatably, FIG. 6 shows a variant in which the bar screen 20 is arranged stationary between the housing 1 and an equally fixed component 37. The component 37 also bears the stationary ring 32 of the dynamic separating arrangement, the rotating ring 33 of which is borne by the hub part 29 which is connected to the shaft 3 so as to be fixed against rotation. The chamber 38 lying on the discharge side of the bar screen 20 and of the friction gap 25 is connected to the outlet channel 23. In the agitator mill according to the invention the gap widths of the dynamic friction gap 25 and the bar screen 20 are chosen to be between 0.05 mm and 3 mm depending upon the application.

The friction gap advantageously has a width which is ¼ to ⅓ of the diameter of the auxiliary grinding elements.

In this case the opening of the static separating arrangement and the opening of the dynamic separating arrangement can be of different widths.

There are also numerous possibilities for the configuration of the shape and cross-section of the bar screen 20. Thus for example the elements of the bar screen 20 defining the separating gaps 20*a* could be of triangular shape (cf. FIGS. 2, 3, 5, 6) or rectangular shape (cf. FIG. 4).

We claim:

1. An agitator mill adapted for wet crushing of material for subsequent grinding comprising:

a grinding chamber adapted to contain grinding media, said chamber having a material inlet to introduce fresh material into said chamber to be crushed and an outlet for the discharge of the crushed material;

static separating means having spaced apart elements arranged upstream of said chamber outlet and fixed with respect to one another providing at least one static opening of predetermined width dimensioned to enable crushed material to pass through said static opening for discharge through said outlet while prohibiting the passage of the grinding media; and separate dynamic separating means having spaced apart elements arranged upstream of said chamber outlet in parallel operational relation to said elements of said static separating means, said dynamic elements being movable with respect to one another providing at least one dynamic opening of predetermined width dimensioned to enable crushed material to pass through said dynamic opening for discharge through said outlet while prohibiting the passage of the grinding media, said dynamic separating means comprising a substantially rotationally stationary ring and a rotatable ring adjacent but radially spaced from said stationary ring to provide an annular gap between said rings defining said dynamic opening, said substantially stationary ring being capable of radial floating movement with respect to said rotatable ring.

2. The mill of claim 1 wherein static and dynamic outlets provide alternative screened flow paths for crushed material exiting said chamber through said chamber outlet.

3. The mill of claim 1 wherein said elements of said static separating means comprise a plurality of annular bars formed of bar screen material.

4. The mill of claim 1 wherein said elements of said static separating means are stationary with respect to said grinding chamber.

5. The mill of claim 1 including a rotatably driven component rotatable with respect to said chamber when said mill is operational, said static separating means being rotatable with said rotatably driven component.

6. The mill of claim 5 including a turbulent motion generator fixed against rotation relative to said static separating means adjacent an upstream side of said static separating means.

7. The mill of claim 6 wherein said turbulent motion generator comprises a plurality of helical centrifugal vanes arranged to direct entrained grinding media away from said dynamic separating means.

8. The mill of claim 1 wherein said at least one static opening and said annular gap are of different widths.

9. The mill of claim 1 wherein said at least one dynamic opening has a width that is ¼ to ⅓ the diameter of the grinding media.

10. The mill of claim 1 wherein said stationary ring is supported within an annular recess sized with respect to said stationary ring to enable said stationary ring to float radially within said groove relative to said rotatable ring.

11. The mill of claim 1 wherein each of said stationary and rotatable rings is formed of wear-resistant material.

* * * * *